US006814424B2

(12) United States Patent
Park

(10) Patent No.: US 6,814,424 B2
(45) Date of Patent: Nov. 9, 2004

(54) MAINTENANCE APPARATUS OF AN INKJET PRINTER AND METHOD THEREOF

(75) Inventor: Jin-ho Park, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 54 days.

(21) Appl. No.: 10/292,629

(22) Filed: Nov. 13, 2002

(65) Prior Publication Data

US 2003/0090535 A1 May 15, 2003

(30) Foreign Application Priority Data

Nov. 13, 2001 (KR) ..... 10-2001-0070522
Sep. 10, 2002 (KR) ..... 10-2002-0054540

(51) Int. Cl.[7] ..... B41J 2/165

(52) U.S. Cl. ..... 347/29; 347/30; 347/32; 347/33

(58) Field of Search ..... 347/22–35

(56) References Cited

U.S. PATENT DOCUMENTS 5,682,186 A * 10/1997 Bohorquez et al. ..... 347/29
6,010,203 A * 1/2000 Muraki ..... 347/30
6,203,136 B1 * 3/2001 Takahashi et al. ..... 347/32
6,260,943 B1 * 7/2001 Ishikawa ..... 347/32
6,318,835 B2 * 11/2001 Nakahara ..... 347/30
6,328,412 B1 12/2001 Taylor et al. ..... 347/32
6,371,595 B1 * 4/2002 Takemoto et al. ..... 347/33

FOREIGN PATENT DOCUMENTS

JP 64-087695 3/1989
JP 02-045156 2/1990
JP 05-208054 8/1993

* cited by examiner

*Primary Examiner*—Shih-Wen Hsieh
(74) *Attorney, Agent, or Firm*—Staas & Halsey LLP

(57) ABSTRACT

A maintenance apparatus of an inkjet printer includes a housing, a capping member disposed in the housing and having two caps closing up surfaces of ink injection nozzles of two printing heads, respectively, a wiping member disposed in the housing and having a wiper wiping the surfaces of the ink injection nozzles, a transmission disposed on the housing reducing a rotation force from a driving source, a capping member mover changing the rotation force of the transmission into a vertical force to move the capping member in a capping position in a capping operation, and a wiping member mover changing the rotation force of the transmission into a horizontal force to move the wiping member in a wiping position in a wiping operation, wherein the wiping operation of the wiping member and the capping operation of the capping member, or an capping-release operation of the capping member and the wiping operation of the wiping member are successively performed in response to the rotation force of the transmission. Accordingly, the maintenance apparatus can stably perform a maintenance operation as well as minimize a size thereof.

66 Claims, 9 Drawing Sheets

MAINTENANCE APPARATUS OF AN INKJET PRINTER AND METHOD THEREOF

CROSS-REFERENCE TO RELATED APPLICATIONS

This application claims the benefit of Korean Patent Application Nos. 2001-70522, filed Nov. 13, 2001, and 2002-54540, filed Sep. 10, 2002, in the Korean Intellectual Property Office, the disclosures of which are incorporated herein by reference.

BACKGROUND OF THE INVENTION

1. Field of the Invention

The present invention relates to a maintenance apparatus of an inkjet printer having ink ejection nozzles, a capping member, and a wiping member, and more particularly to, a maintenance apparatus of an inkjet printer performing a stable maintenance operation as well as being minimized in size and a method thereof.

2. Description of the Related Art

Generally, an inkjet printer includes a paper feeder supplying paper one by one, a paper transporter transporting the paper supplied from the paper feeder one line at a time, a printing part printing data on the paper transported by the paper transporter, a paper-discharging part discharging the paper printed by the printing part, and a maintenance apparatus cleaning a surface of an ink ejection nozzle of at least one printing head, storing ink spat in a cleaning operation, and closing up the surface of the ink ejection nozzle when the printing head is not used.

Among these components of the inkjet printer, the maintenance apparatus maintains and preserves the ink ejection nozzle of the printing head in a normal state and is an apparatus essential to ensure the printing head to perform a good printing function.

The maintenance apparatus generally has a structure capping and wiping the surface of the ink ejection nozzle by using a cap and a wiper that are mounted on a moving member. The moving member disposed to be moved along tilted guide slots is ascended and descended by a moving force of a carriage in which the printing head is mounted.

Referring to FIG. 1, there is illustrated an example of the inkjet printer in which a conventional maintenance apparatus 10 capping and wiping a surface of an ink ejection nozzle 3 by using a moving force of a carriage 1 is mounted.

The maintenance apparatus 10 is disposed at a maintenance area to clean and close up the surface of the ink ejection nozzle 3 of a printing head 2 using a wiper 22 and a cap 34, respectively, when the printing head 2 mounted in the carriage 1 is in a standby mode or not used for a long time after completing a printing operation of ejecting ink on paper by moving right and left in a printing area by a motor (not shown) driving the printing head 2.

As shown in FIGS. 2 through 3B, the maintenance apparatus 10 comprises a capping member 30 moving from a standby position, as shown in FIG. 3A, opening the surface of the ink ejection nozzle 3 to a capping position, as shown in FIG. 3B, closing up the surface of the ink ejection nozzle 3 by ascending by the moving force of the carriage 1 when the carriage 1 is moved to a maintenance area, a wiping member 20 vertically ascending and descending a wiper 22 wiping the surface of ink ejection nozzle 3 by being rotated right and left by a movement of the capping member 30, and an elastic member 40 elastically returning the capping member 30 from the capping position to the standby position when the carriage 1 is moved to the printing area.

The capping member 30 includes a cap case 31 having a pusher 32 projecting upwardly from one side of an upper surface thereof to be pushed by the carriage 1 and guide projections 38 formed on both side walls thereof to be respectively inserted in first guide slots 15 of a housing 11; and a cap 34 disposed on the upper surface of the cap case 31.

The cap 34 formed of a rubber material is fixed on a top of an axis part 37 enclosed by a spring 33. Accordingly, the cap 34 is pushed upwardly by an elastic force of the spring 33 to close up the surface of the ink ejection nozzle 3 of the printing head 2 during a capping operation.

The wiping member 20 includes a wiper body 21 having a wiper 22 formed of a rubber material and projecting upwardly therefrom and wiper axis parts 23 projecting from both sides thereof to be inserted in wiper axis-receiving slots 14 of the housing 11; and an operating rack 24 disposed below the wiper body 21 and having an operating lever 25 which is moved right and left by the cap case 31 of the capping member 30 to ascend and descend the wiper body 21.

The elastic member 40 is a tension spring having one end fixed to a spring hanging piece 16 formed on a bottom of the housing 11, and the other end fixed to a spring hanging hook 36 formed on a lower part of the cap case 31.

In a maintenance operation, the printing head 2 mounted in the carriage 1 is moved to the maintenance area after completing the printing operation of ejecting ink on paper by moving right and left in the printing area by the motor driving the printing head 2, as shown in FIG. 3A.

When the carriage 1 moves to the maintenance area, the printing head 2 mounted in the carriage 1 passes over the wiper 22 of the wiping member 20. However, at this time, since the wiper 22 is maintained in a descended position, the surface of the ink ejection nozzle 3 of the printing head 2 is not wiped.

After that, when the carriage 1 continuously moves right and is disposed above the cap 34, the carriage 1 pushes a pusher 32 right against a tension force of the tension spring 40 as shown in a dotted line in FIG. 3A. As a result, the cap case 31 is moved right together with the carriage 1 and at the same time ascends by the guide projections 38 slid along the first guide slots 15.

Accordingly, the cap 34 fixed on the upper surface of the cap case 31 is gradually raised together with the cap case 31 and then disposed in the capping position to completely close up the surface of the ink ejection nozzle 3 to prevent ink from being dried off.

Also, at this time, a sliding end 26a of the operation lever 25 is slid from a right end to a left end of a second guide slot 35 and then pulled right by the left end thereof. Accordingly, the operating rack 24 is rotated clockwise until being stopped at a vertical position by a stopping projection (not shown). Consequently, the wiper body 21 having the wiper 22 formed on the upper surface thereof is engaged with a raising portion 24*a* of the operating rack 24 and thereby disposed in a position (FIG. 3A) by ascending upwardly as much as a vertical height raised by the raising portion 24*a*.

Thereafter, when a printing command is generated, the carriage 1 is moved in a direction toward the printing area disposed on a left side of the position shown in FIG. 3B to move away from the cap case 31.

Accordingly, the cap case 31 is lowered since the guide projections 38 are slid left along the first guide slots 15 by a restoring force of the tension spring 40.

At this time, the sliding end 25*a* of the operation lever 25 is slid from the left end to the right end of the second guide slot 35 and then pushed left by the right end thereof. Accordingly, the operating rack 24 is rotated counterclockwise.

As a result, the wiper body 21 descends after being maintained in an ascending position as much as a width of the raising portion 24*a* of the operating rack 24.

In a state that the wiper body 21 is maintained in the ascended position, when the carriage 1 continuously moves to make the printing head 2 to pass above the wiper body 21, the surface of the ink ejection nozzle 3 is wiped by the wiper 22 of the wiper body 21 which is maintained in the ascending position.

After the surface of the ink ejection nozzle 3 is wiped, when the operating rack 24 is further rotated counterclockwise by the right end of the second guide slot 35 pushing left the sliding end 25*a* and thereby the wiper body 21 is engaged with a lowering portion 24*b* of the operating rack 24, the wiper body 21 is lowered by the lowering portion 24*b* to be disposed in the position (FIG. 3A) descending as much as a vertical height.

After that, the carriage 1 is moved to the printing area to perform the printing operation by moving right and left the printing head 2.

As described above, the maintenance apparatus 10 has a structure that in order to ascend and descend the cap case 31 by using the moving force of the carriage 1, the guide projections 38 of the cap case 31 are moved along the first guide slots 15 having a given tilt angle with the surface of the ink ejection nozzle 3. Therefore, the smaller the tilt angle of the first guide slots 15 is, the better and the more smoothly the cap case 31 can be moved along the first guide slots 15. In this case, however, a movement distance of the cap case 31 is lengthened as much as the tilt angle of the first guide slots 15 is reduced, thereby resulting in an increase in a size of the maintenance apparatus 10 and the inkjet printer.

Particularly, to reduce a movement distance of the cap case 31, if the first guide slots 15 are tilted at an angle of more than 45°, it is very difficult for the cap case 31 to smoothly ascend or descend along the first guide slots 15, and a noise is severely generated.

Also, in the conventional maintenance apparatus 10, during the capping operation, the cap 34 obliquely ascends at a horizontal positioned state to be in contact with the surface of the ink ejection nozzle 3, and then closes up the ink injection nozzle 3 by being further pushed.

Accordingly, in the capping operation, a pressure in a seated space between the cap 34 and the printing head 2 is increased in a moment, thereby generating pressured air flowing into capillaries of the ink ejection nozzle 3. As a result, in the printing operation, the ink ejection nozzle 3 of the printing head 2 is not able to eject ink normally, thereby causing a problem of deteriorating printing quality and reliability of the inkjet printer.

SUMMARY OF THE INVENTION

Therefore, it is an object of the present invention to provide an improved maintenance apparatus of an inkjet printer which can stably perform a maintenance operation as well as minimize a size thereof.

It is another object to provide an improved maintenance apparatus of an inkjet printer which can increase reliability thereof by preventing an operation error of ink ejection nozzles generated due to a clog of the ink occurring caused by an inflow of pressured air thereinto in a capping operation.

Additional objects and advantages of the invention will be set forth in part in the description which follows and, in part, will be obvious from the description, or may be learned by practice of the invention.

These and other objects of the present invention may be achieved by providing a maintenance apparatus of an inkjet printer including a housing, a capping member disposed in the housing and having at least one cap closing up a surface of an ink ejection nozzle of at least one printing head, a wiping member disposed in the housing and having a wiper wiping the surface of the ink ejection nozzle of the printing head, a transmission disposed on the housing to receive a rotation force from a driving source, a capping member mover changing the rotation force of the transmission into a vertical force and transmitting the vertical force to the capping member, a wiping member mover changing the rotation force of the transmission into a horizontal force and transmitting the vertical force to the wiping member, and wherein a wiping operation of the wiping member wiping the surface of the ink ejection nozzle and a capping operation of the capping member closing up the surface of the ink ejection nozzle are successively performed when the transmission is operated to transmit the rotation force in one of clockwise and counterclockwise directions, and a capping-release operation of the capping member opening the surface of the ink nozzle and the wiping operation of the wiping member are successively performed when the transmission is operated to transmit the rotation force in the other one of the clockwise and counterclockwise directions.

The transmission includes at least one gear member operatively connected to the capping member mover and the wiping member mover to reduce the rotation force received from the driving source and transmit the reduced rotation force to the capping member mover and the wiping member mover. Preferably, the driving source is a separate motor different from a motor driving the printing head.

The capping member mover includes a connecting pin rotatably coupling one end of the capping member to the housing to serve as a hinge of the capping member and a first crank mechanism having a crank gear engaged with the gear member of the transmission, a crank axle coaxially connected to the crank gear, at least one first crank arm having one end connected to the crank axle, and at least one first connecting rod having one end connected to the other end of the first crank arm and the other end connected to the other end of the capping member. Preferably, the connecting pin of the capping member mover is disposed to allow the cap disposed on an upper surface of the capping member to come in contact with the surface of the ink ejection nozzle at a given-initial angle from the surface of the ink injection nozzle and then gradually to close up the surface of the Ink ejection nozzle when the capping member is moved to a capping position to close up the surface of the ink ejection nozzle.

The wiping member mover includes at least one guide groove formed at the housing, at least one slide projection formed on the wiping member horizontally to slide in and along the guide groove, and a second crank mechanism having the crank gear engaged with the gear member of the transmission, the crank axle coaxially connected to the crank gear, at least one second crank arm having one end connected to the crank axle, and at least one second connecting rod having one end connected to the other end of the second crank arm and the other end connected to one end of the wiping member.

The capping member mover and the wiping member mover are disposed to ensure that the capping member and the wiping member are moved in a direction perpendicular to a moving direction of the printing head.

In the maintenance apparatus of the invention, the wiping member includes a used ink-storing part receiving ink spat through the ink ejection nozzle of the printing head during a spitting operation of the printing head.

Also, the maintenance apparatus further includes a stopper stopping the first crank mechanism of the capping member mover to a position having a given capping-maintaining angle beyond a top dead center thereof, to maintain the capping member in the capping position, even though an electrical source of the driving source of the transmission is switched off from the driving source or the capping member is left as is in the capping position for a long time after being arrived at the capping position. Preferably, the stopper includes a projecting part formed in the guide groove of the housing to block movement of the slide projection of the wiping member. Also, preferably, the capping-maintaining angle is set within the range of 2°–10°.

BRIEF DESCRIPTION OF THE DRAWINGS

These and other objects and advantages of the invention will be apparent and more readily appreciated from the following description of the preferred embodiments, taken in conjunction with the accompanying drawings of which.

DETAILED DESCRIPTION OF THE PREFERRED EMBODIMENTS

Figure 1:
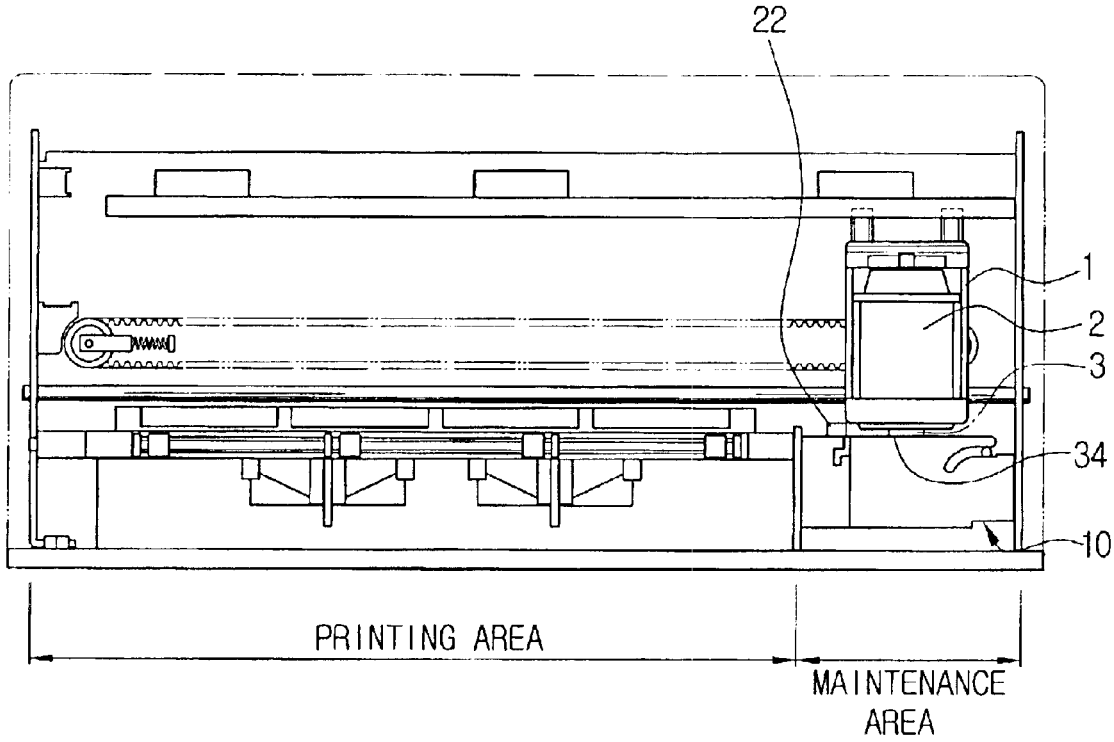
FIG. 1 (PRIOR ART)
FIG. 1 is a front view of a conventional inkjet printer.
Figure 2:
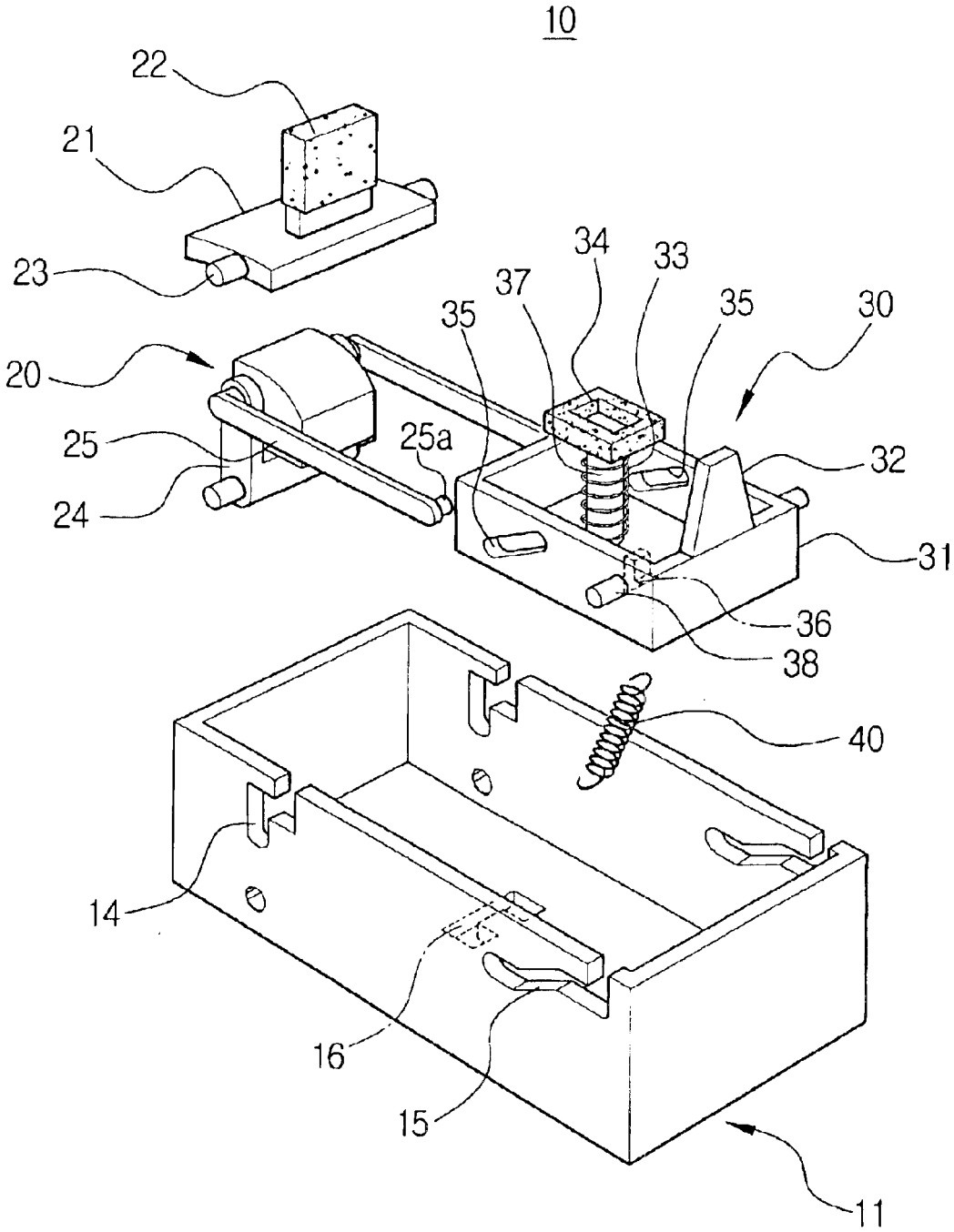
FIG.2 (PRIOR ART)
FIG. 2 is an exploded perspective view of a maintenance apparatus of the inkjet printer shown in FIG. 1.
Figure 3A:
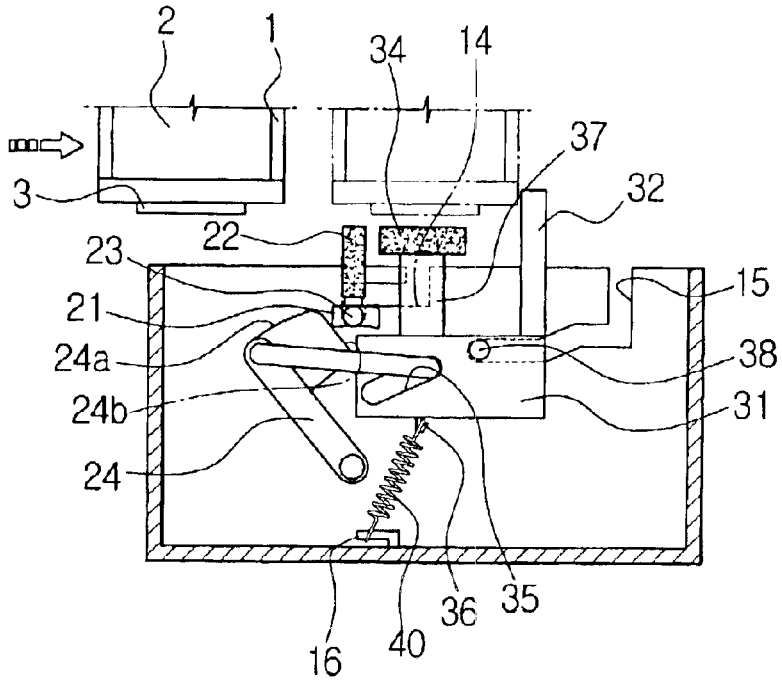
FIG.3A (PRIOR ART)
FIGS. 3A and 3B are front cross-sectional views of the maintenance apparatus of the inkjet printer shown in FIG. 1.
Figure 3B:
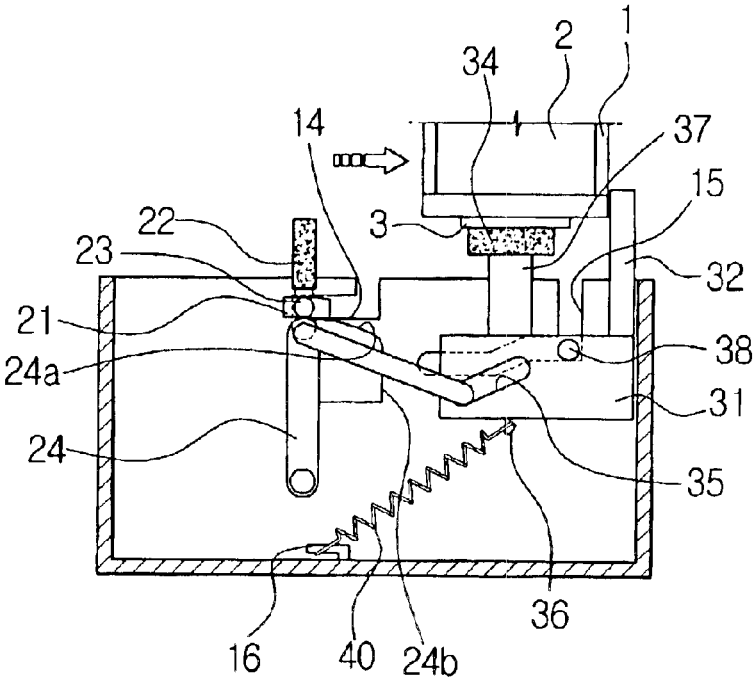
FIG.3B (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
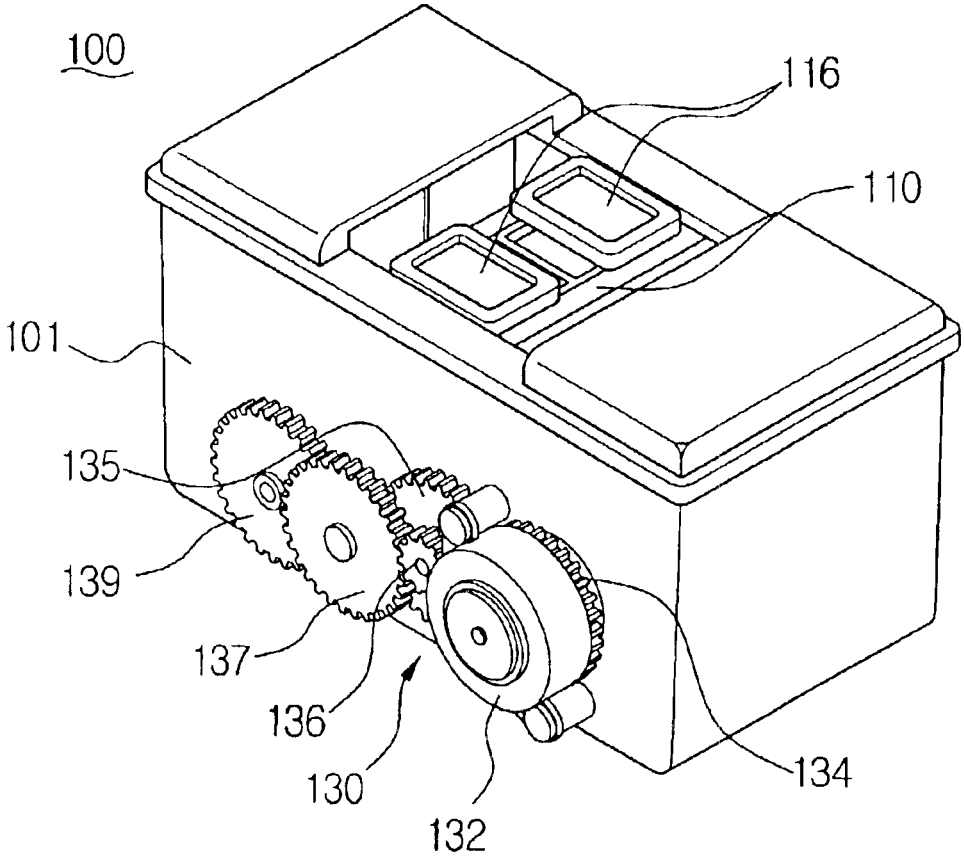
FIG. 4 is a perspective view of a maintenance apparatus of an inkjet printer in accordance with an embodiment of the present invention.
Figure 5:
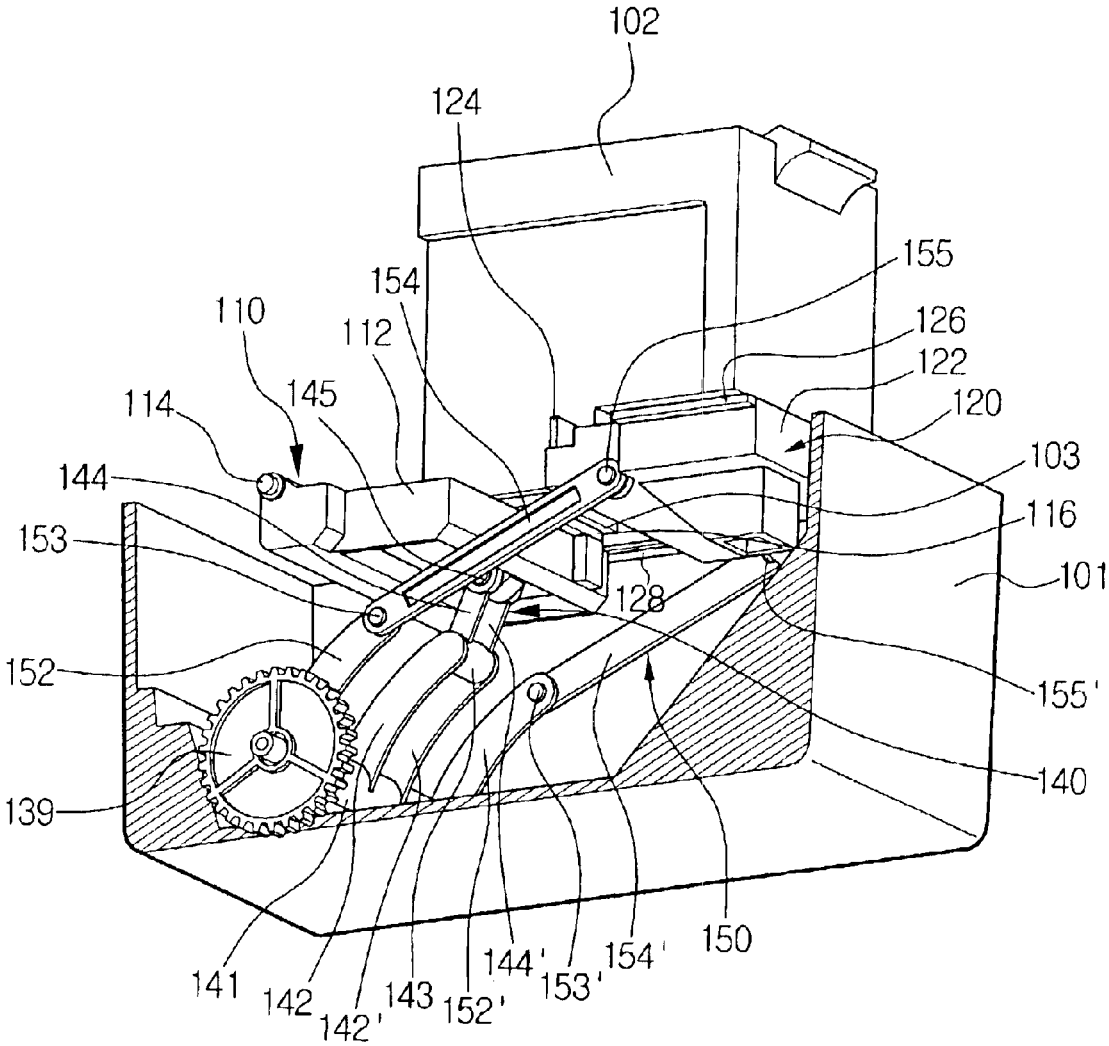
FIG. 5 is another perspective view of the maintenance apparatus shown in FIG. 4.

Referring now to FIGS. 4 and 5, there is illustrated a maintenance apparatus 100 in accordance with an embodiment of the present invention.

Figure 6A:
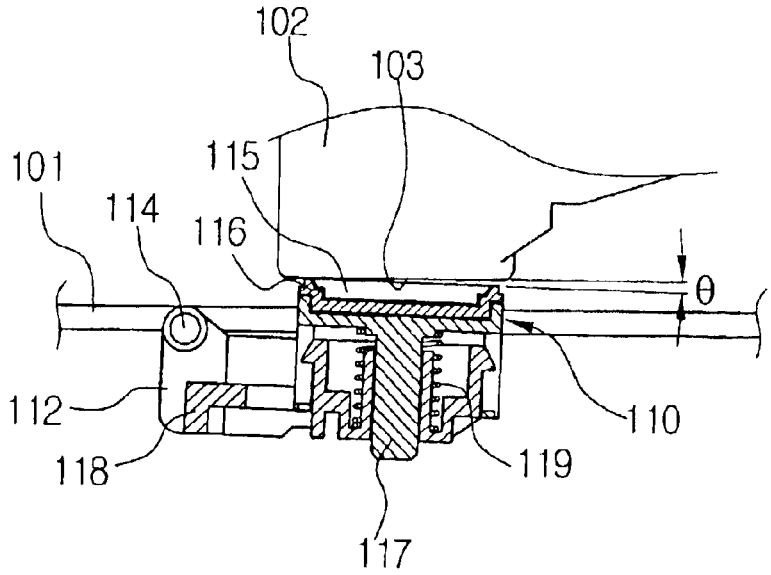
FIGS. 6A and 6B are partial cross-sectional views of a capping member of the maintenance apparatus of FIG. 4.

The maintenance apparatus 100 includes a housing 101 coupled with a main frame (not shown), a capping member 110 disposed in the housing 101 and having two caps 116 closing up surfaces of ink ejection nozzles 103, as shown in FIG. 6A, of two printing heads 102 (only one shown in drawings) for monochrome and multicolored printing, respectively, a wiping member 120 disposed in the housing 101 and having a wiper 124 wiping the surfaces of the ink ejection nozzles 103 of the printing heads 102, a transmission 130 having a driving motor 132 and gears 134, 135, 136, 137, and a crank gear 139 coupling the transmission 130 to the capping and wiping members 110, 120.

Figure 6B:
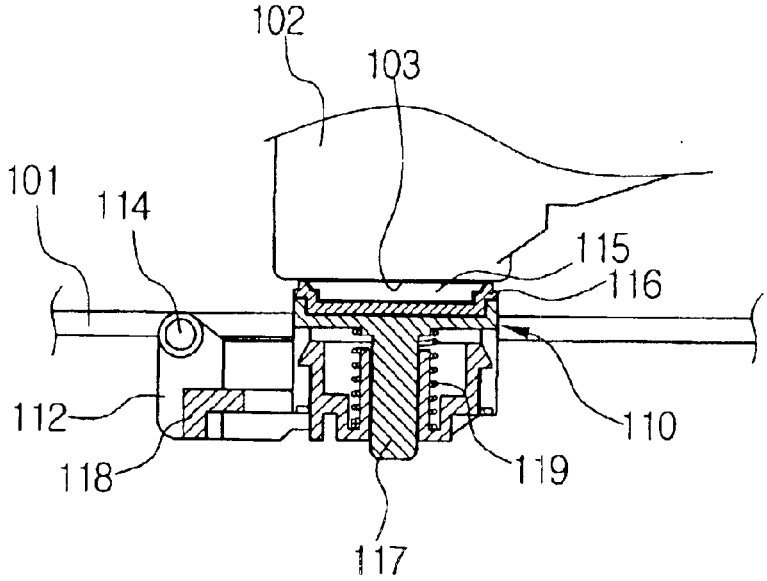

The capping member 110 includes a rotation movement body 112 and the caps 116 formed on an upper surface thereof. As shown in FIGS. 6A and 6B, the caps 116 are mounted on a cap holder 117 that is elastically supported on a fixing part 118 of the rotation movement body 112 by an elastic spring 119. A sealed space 115 is formed between the cap 116 and the ink injection nozzle 103 of the printing head 102. The rotation movement body 112 rotates about a first connecting pin 14 with respect to the housing 101.

The wiping member 120 includes a horizontal movement body 122 and the wiper 124 disposed at one side of an upper surface thereof. As shown in FIGS. 7, 8A, 8B and 8C, a used ink-storing part 125 is formed at the upper surface of the horizontal movement body 122. The used ink-storing part 125 functions to receive and store ink spat through the ink ejection nozzles 103 of the printing heads 102 in a spitting operation to clean the surface of the ink ejection nozzle 103 stained with particles or other adjacent ink with the wiper 124 in a spitting position as shown in FIG. 8A after or before the wiping operation is performed by the wiper 124 to wipe the surface of the ink ejection nozzle 103. The used ink-storing part 125 has a used ink-storing groove (not shown) and an ink absorbing material (not shown) disposed in the used ink-storing groove.

Referring again to FIGS. 4 and 5, the maintenance apparatus 100 includes the transmission 130 receiving a rotation force from the separate driving motor 132, which is different from a carriage motor driving the printing heads 102 left and right, a capping member mover 140 having a first crank mechanism 180 changing the rotation force of the transmission 130 into a vertical force and transmitting the vertical force to the capping member 110, and a wiping member mover 150 having a second crank mechanism 181 changing the rotation force of the transmission 130 into a horizontal force and transmitting the horizontal force to the wiping member 120.

The transmission 130 has a first gear 134 connected to an axle of the driving motor 132 to reduce the rotation force transmitted therefrom, a second gear 135 engaged with the first gear 134, a third gear 136 coaxially coupled to the second gear 135, a fourth gear 137 engaged with the third gear 136, and a fifth gear (not shown) coaxially coupled to the fourth gear 137.

Figure 8A:
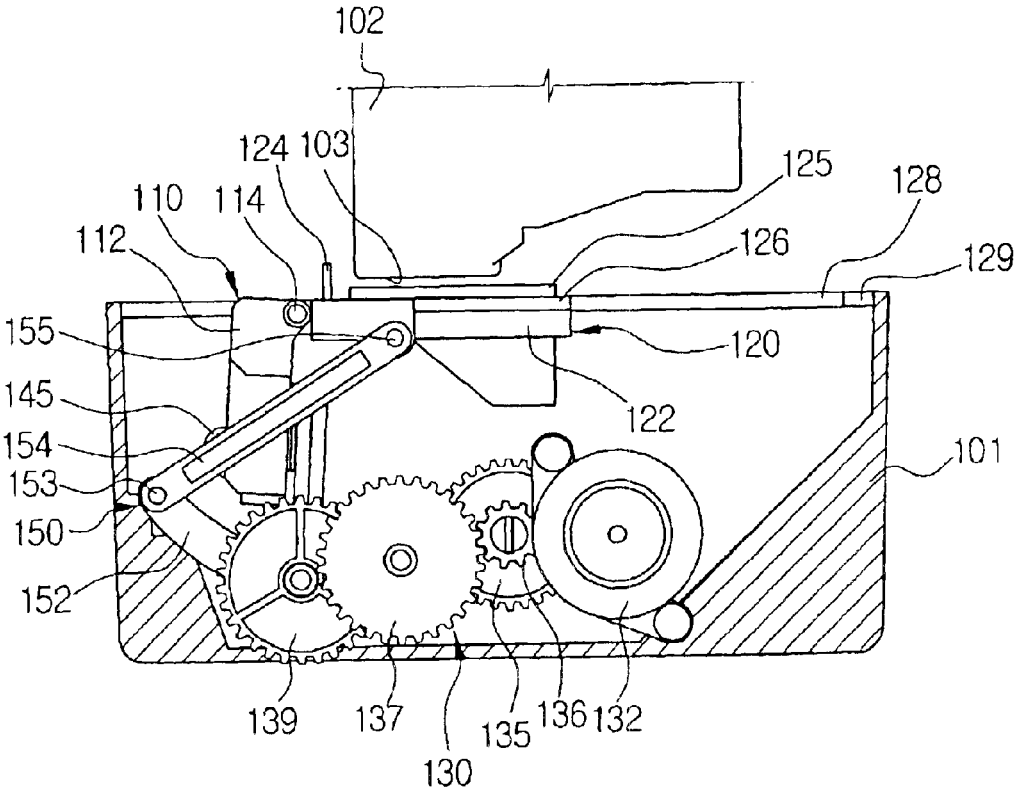
FIGS. 8A, 8B, and 8C are front views illustrating spitting, wiping, and capping operations, respectively, of the maintenance apparatus shown in FIG. 5.
Figure 8B:
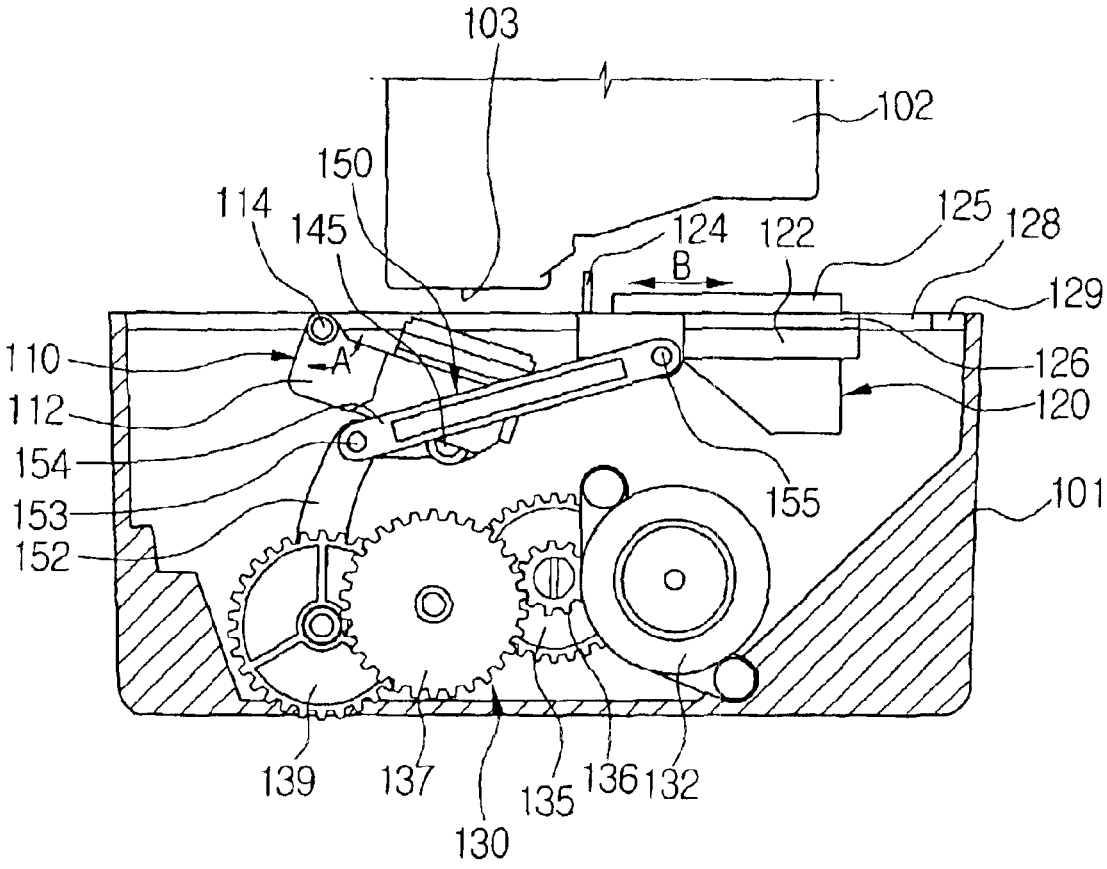
Figure 8C:
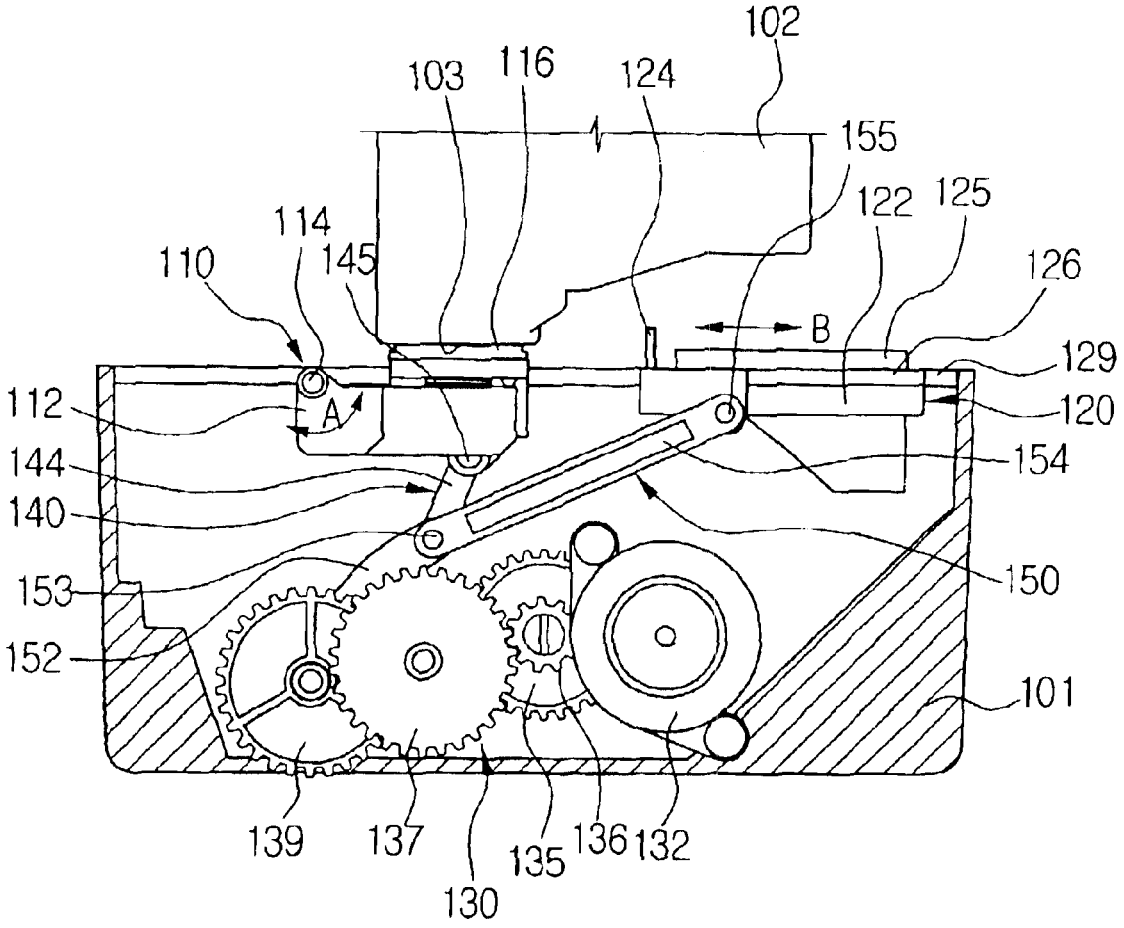

The capping member mover 140 includes a first connecting pin 114 hingedly fixing one end of the rotation movement body 112 on the housing 101 so as to support the rotation movement body 112 rotatably in an arrow direction A as shown in FIGS. 8B and 8C, and the first crank mechanism connected with the fifth gear of the transmission 130.

The first connecting pin 114 is disposed to allow the caps 116 disposed on an upper surface of the rotation movement body 112 to be in contact with the ink ejection nozzles 103 at a given-initial angle θ with respect to the surface of the ink injection nozzle 103 and then gradually close up the surfaces of the ink ejection nozzles 103 when the capping member 110 is moved to a capping position FIG. 8C to close up the surfaces of the ink ejection nozzles 103. The given-initial angle θ is greater than zero and less than 10°.

The first crank mechanism has a crank gear 139 connected to the fifth gear of the transmission 130, a crank axle 141 coaxially connected to the crank gear 139, two first crank arms 142, 142', each of which being connected to the crank axle 141 by one end, and two first connecting rods 144, 144', each of which being connected to the other end of the first crank arm 142 or 142' by one end through a second connecting pin 143 and connected to a lower portion of the other end of the rotation movement body 112 by the other end through a third connection pin 145.

The wiping member mover 150 has two elongated guide grooves 128 formed at both inside surfaces of an upper part of the housing 101 as shown in FIG. 8A, two elongated slide projections 126 formed respectively on both side surfaces of the horizontal movement body 122 corresponding to the guide grooves 128 to slide in an arrow direction 8 of FIG. 8B perpendicular to the movement direction of the printing heads 102, i.e., a horizontal direction along the guide grooves 128, and the second crank mechanism connected with the fifth gear of the transmission 130. The second crank mechanism includes the crank gear 139 connected with the fifth gear of the transmission 130, the crank axle 141 coaxially connected with the crank gear 139, two second crank arms 152, 152', each of which being connected to the crank axle 141 by one end, and two second connecting rods 154, 154', each of which being connected to the other end of the second crank arm 152 or 152' by one end through a fourth connecting pin 153 or 153' and connected to one end of the horizontal movement body 122 by the other end through a fifth connecting pin 155 or 155'.

Accordingly, as shown in FIGS. 5, 6A, 6B, 8A and 8C, the rotation movement body 112 of the capping member 110 is rotated in a counterclockwise direction to be moved from a cap standby position shown in FIG. 8A to a capping position shown in FIG. 8C to close up the surfaces of the ink ejection nozzles 103. When the crank gear 139 and the first crank arms 142, 142' of the first crank mechanism 140 are rotated in a clockwise direction by a counterclockwise rotation of the fifth gear of the transmission 130, the caps 116 disposed on the upper surface of the rotation movement body 112 come in contact with the surfaces of the ink ejection nozzles 103 at a given-initial angle θ of FIG. 6A with respect to the surfaces of the ink injection nozzles 103 and then gradually close up the surfaces of the ink ejection nozzles 103. Therefore, in an ink ejection operation, the printing heads 102 do not generate an operation error, such as a clog of the ink ejection nozzles 103 by an inflow of pressured air into capillaries thereof due to an instant pressure change between the caps 116 and the surfaces of the ink ejection nozzles 103 in the capping operation, such as an operation error occurring in the conventional maintenance apparatus 10.

At this time, the horizontal movement body 122 of the wiping member 120 is moved from a first wiper position as shown in FIG. 8 to the right in a horizontal direction by the rotation of the crank gear 139 and the second crank arms 152, 152' of the second crank mechanism 150 to wipe the surfaces of the ink ejection nozzles 103 with the wiper 124, and then positioned in a second wiper standby position of FIG. 8C.

Also, when the crank gear 139 coupled to the first and second crank mechanisms 140, 150 is rotated in the counterclockwise direction by the fifth gear of the transmission 130, the capping member 110 is clockwise rotated by the first crank mechanism 140 from the capping position (FIG. 8C) to a cap standby position (FIG. 8A), whereas the wiping member 120 is moved to the left by the second crank mechanism 150 to wipe the surfaces of the ink ejection nozzles 103 with the wiper 124 and then positioned in a spitting position (FIG. 8A), in which the printing heads 102 carry out a spitting operation, and in another wiper standby position as shown in FIG. 8A.

In the maintenance apparatus 100, the housing 101 includes a stopper 129 maintaining the capping member 110 stably in a capping position without opening the surfaces of the ink ejection nozzles 103 due to the elastic spring 119 disposed between the cap holder 117 and the fixing part 118 as shown in FIGS. 6A, 6B, 8A, and 8B, even though a source of electricity is switched off or the capping member 110 has been left in the capping position for a long time. The stopper 129 includes projection parts which are respectively formed in the guide grooves 128 of the housing 101.

Figure 7:
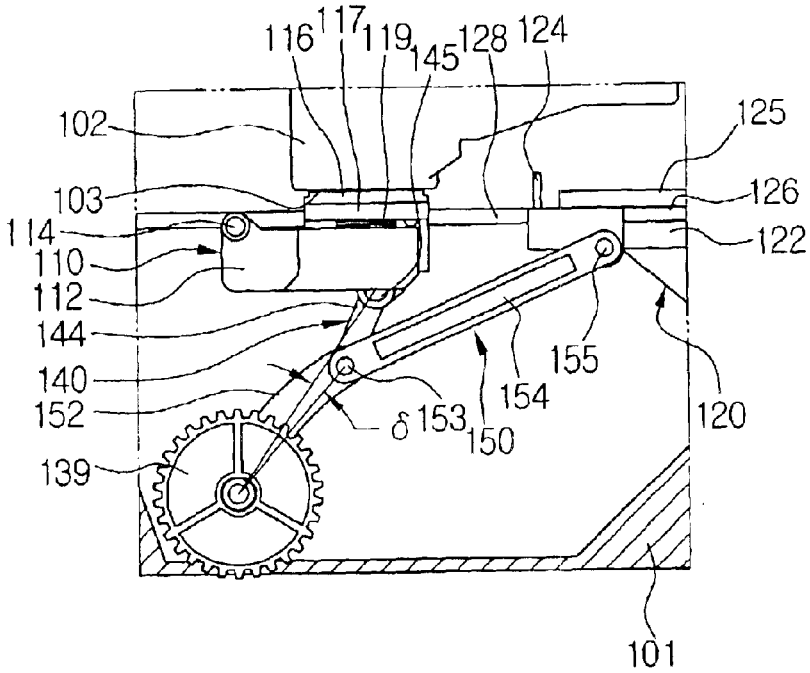
FIG. 7 is a partial front view illustrating transmitting operations of first and second crank mechanisms of the maintenance apparatus of FIG. 5.

As shown in FIG. 7, in order to stop the first crank mechanism at a position at a given capping-maintaining angle δ beyond a top dead center of the cap member mover 140 corresponding to a top position of the caps 116 closing up the surface of the ink injection nozzle 103, the stopper 129 functions to block movement of the slide projections 126 of the horizontal movement body 122 of the wiping member 120 which is linked to the first crank mechanism through the second crank mechanism. Preferably, the capping-maintaining angle δ is set within the range of 2°–10°.

As described above, the maintenance apparatus 100 of the present invention can stably carry out maintenance operation such as capping, wiping, spitting and the like as well as minimize a size thereof by coupling the first and second crank mechanisms to the capping member 110 and the wiping member 120 to control the capping member 110 and the wiping member 120 to be moved in a direction perpendicular to the moving direction of the printing heads 102.

A method of operation of the maintenance apparatus 100 of the inkjet printer in accordance with the present invention will now be explained with reference to FIGS. 4 through 8.

First, the printing heads 102 mounted in a carriage are moved to a maintenance area after completing a printing operation, i.e., after ejecting ink on paper in a right or left movement within a printing area by a driving motor driving the printing heads 102.

As shown in FIG. 8A, after the printing heads 102 move into the maintenance area, a separate driving motor 132 is operated to transmit a clockwise rotation force thereof to a crank gear 139 via a first gear 134 through a fifth gear (not shown) coaxially coupled to the fourth gear 137. The capping member 110 and the wiping member 120 are in the cap standby position and the first wiper standby position, respectively.

As shown in FIG. 8B, as the crank gear 139 is rotated in the clockwise direction, a crank axle 141 coaxially coupled to the crank gear 139 is also rotated in the clockwise direction, and thereby the rotation movement body 112 of the capping member 110 positioned at a cap standby position is in the counterclockwise direction about the first connecting pin 114 by a first crank mechanism of the capping member mover 140. At this time, the horizontal movement body 122 of the wiping member 120 is moved to the right in a horizontal direction by sliding slide projections 126 in and along guide grooves 128 of the housing 101 by the second crank mechanism of a wiping member mover 150.

As the horizontal movement body 122 is moved to the right, the wiper 124 projected upwardly from one side surface of the horizontal movement body 122 is also moved to the right to perform a wiping operation of cleaning particles, other adjacent ink, and the like that remain on the surfaces of ink ejection nozzles 103 of the printing heads 102.

After that, as the rotation movement body 112 is continuously rotated by the crank gear 139, caps 116 disposed on the upper surface of the rotation movement body 112 of the capping member 110 gradually close up the surfaces of the ink ejection nozzles 103 of the printing heads 102 after one side portion thereof adjacent to the first connecting pin 114 first reaches the surfaces of the ink ejection nozzles 103 at a given-initial angle 0 with respect to the surface of the ink injection nozzles 103 as shown in FIG. 6A. At this time, since the caps 116 gradually close up the surfaces of the ink ejection nozzles 103 as shown in FIG. 6B, due to the given-initial angle 0 the sealed space 115 is not rapidly formed, and an operation error, such as clogging of the ink ejection nozzles 103 due to the inflow of the pressured air thereinto which occurs in the conventional maintenance apparatus 10, is prevented.

When the first crank mechanism of the cap member mover 140 arrives at a top dead center thereof, first crank arms 142, 142' of the first crank mechanism are further rotated to a position having the given capping-maintaining angle δ beyond the top dead center so as to maintain the capping member 110 stably in the capping position as shown in FIG. 7. At this time, since the air pressure in the sealed space 115 Is decreased as the caps 116 of the capping member 110 are slightly lowered, there is no problem like an additional air pressure causing the inflow of the pressured air into capillaries of the ink ejection nozzles 103.

When the first crank arms 142, 142' arrive at the position having the given capping-maintaining angle δ, a source of electricity for the driving motor 132 is switched off, and at the same time, the slide projections 126 of the horizontal movement body 122 are blocked by a stopper 129, thereby causing the first and second crank mechanisms which are coupled with the horizontal movement body 122, to be successively stopped. Accordingly, the rotation movement body 112 of the capping member 110 is maintained at the capping position (FIG. 8C) in which the caps 116 close up the surfaces of the ink injection nozzles 103 of the printing heads 102.

Next, when a printing command is generated, the rotation movement body 112 of the capping member 110 and the horizontal movement body 122 of the wiping member 120 perform capping-release and wiping operations with the first and second crank mechanisms in a reverse order from the respective positions shown in FIG. 8C to the respective positions of FIG. 8A.

After the capping-release and wiping operations, when one side of the horizontal movement body 122 of the wiping member 120 is blocked and stopped by the first connecting pin 114, the used ink-storing part 125 of the horizontal movement body 122 is positioned at a spitting position below the ink injection nozzles 103 of the printing heads 102, and the spitting operation is performed to dean the surface of the ink injection nozzle 103 stained with particles or adjacent ink by the wiper 103 after the capping-release and wiping operations. At this time, the ink spat from the ink injection nozzles 103 is absorbed by and stored in an ink absorbing material that is disposed in the used ink-storing groove of the used ink storing part 125. Since ink slowly vaporizes and disappears, the ink can be received and stored by the ink absorbing material when the ink is spat from the ink injection nozzles 103 in the next spitting operation.

Thereafter, the printing heads 102 are moved to the printing area by the carriage motor for driving the printing heads 102, and at the printing area, moved to the right and left by the carriage motor to perform the printing operation of ejecting ink on the paper.

As apparent from the foregoing description, it can be appreciated that the maintenance apparatus according to the embodiment of the present invention can stably perform the maintenance operation, such as capping, wiping, spitting and the like as well as minimize the size thereof, by coupling the first and second crank mechanisms with the capping member 110 and the wiping member 120 to ensure the capping member 110 and the wiping member 120 to be moved in the direction perpendicular to the moving direction of the printing heads 102.

Also, the maintenance apparatus can increase reliability thereof by preventing the operation error in the ink ejection, such as clogging of the ink injection nozzles due to the inflow of pressured air thereinto in the capping operation.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A maintenance apparatus of an inkjet printer having a printing head with an ink ejection nozzle, comprising:

a housing;

a capping member disposed in the housing to move between a capping position in a capping operation and a cap standby position in a capping-release operation, and having a cap closing up and opening a surface of the ink ejection nozzle of the printing head;

a wiping member disposed in the housing to move between a wiping position in a wiping operation and a wiper standby position in a wiper standby operation, and having a wiper for wiping the surface of the ink injection nozzle of the printing head;

a transmission unit disposed on the housing to generate a rotation force in a first direction and a second direction in response to an external driving source;

a capping member mover changing the rotation force of the transmission unit into a capping force and transmitting the capping force to the capping member in a capping direction substantially perpendicular to the surface of the ink ejection nozzle: and a wiping member mover changing the rotation force of the transmission unit into a wiping force and transmitting the wiping force to the wiping member in a wiping direction substantially parallel to the surface of the ink injection nozzle;

wherein the wiping operation of the wiping member and the capping operation of the capping member are successively performed when the transmission unit generates the rotation force in the first direction, and the capping-release operation of the capping member of opening the surface of the ink ejection nozzle and the wiping operation of the wiping member are successively performed when the transmission unit generates the rotation force in the second direction opposite to the first direction, wherein the transmission unit includes at least one gear member operatively connected to the capping member mover and the wiping member mover to reduce the rotation force and transmit the reduced rotation force to the capping member mover and the wiping member mover.

2. The maintenance apparatus according to claim 1, wherein the inkjet printer comprises a carriage motor driving the printing head, and the external driving source is different from the carriage motor.

3. A maintenance apparatus of an inkjet printer having a printing head with an ink ejection nozzle, comprising:

a housing;

a capping member disposed in the housing to move between a capping position in a capping operation and a cap standby position in a capping-release operation, and having a cap closing up and opening a surface of the ink ejection nozzle of the printing head;

a wiping member disposed in the housing to move between a wiping position in a wiping operation and a wiper standby position in a wiper standby operation, and having a wiper for wiping the surface of the ink injection nozzle of the printing head;

a transmission unit disposed on the housing to generate a rotation force in a first direction and a second direction in response to an external driving source;

a capping member mover changing the rotation force of the transmission unit into a capping force and transmitting the capping force to the capping member in a capping direction substantially perpendicular to the surface of the ink election nozzle; and a wiping member mover changing the rotation force of the transmission unit into a wiping force and transmitting the wiping force to the wiping member in a wiping direction substantially parallel to the surface of the ink injection nozzle;

wherein the wiping operation of the wiping member and the capping operation of the capping member are successively performed when the transmission unit generates the rotation force in the first direction, and the capping-release operation of the capping member of opening the surface of the ink ejection nozzle and the wiping operation of the wiping member are successively performed when the transmission unit generates the rotation force in the second direction opposite to the first direction, wherein the capping member mover includes:

a connecting pin coupling one end of the capping member to the housing; and a first crank mechanism comprising a crank gear engaged with the transmission, a crank axle coaxially connected to the crank gear, a first crank arm having one end connected to the crank axle, and a first connecting rod having one end connected to the other end of the first crank arm and the other end connected to the other end of the capping member.

4. The maintenance apparatus according to claim 3 wherein the connecting pin of the capping member mover is disposed to allow the cap of the capping member to come in contact with the surface of the ink injection nozzle at a given-initial angle and then gradually close up the surface of the ink injection nozzle when the capping member is moved to the capping position.

5. The maintenance apparatus according to claim 3, wherein the wiping member mover comprises:

a guide groove formed in the housing;

a slide projection formed on the wiping member horizontally to slide in and along the guide groove; and a second crank mechanism comprising the crank gear engaged with the transmission, the crank axle coaxially connected to the crank gear, a second crank arm having one end connected to the crank axle, and a second connecting rod having one end connected to the other end of the second crank arm and the other end connected to one end of the wiping member.

6. The maintenance apparatus according to claim 5 wherein the capping member mover and the wiping member mover are disposed to move the capping member and the wiping member in the capping direction and the wiping direction, respectively, and the capping direction and the wiping direction are perpendicular to a moving direction of the printing head and to each other.

7. The maintenance apparatus according to claim 5, wherein the wiping member includes a used ink-storing part receiving ink spat through the ink injection nozzle of the printing head during a spitting operation of the printing head.

8. The maintenance apparatus according to claim 5, wherein the housing comprises a stopper stopping the second crank mechanism of the wiping member mover and the first crank mechanism of the capping member mover to a stopping position, and the first and second crank mechanisms form a given capping-maintaining angle to maintain the capping member stably in the capping position even though a source of electricity is switched off or the capping member is left in the capping position for a predetermined period of time after arrived at the capping position when the transmission does not generate the rotation force.

9. The maintenance apparatus according to claim 8, wherein the stopper comprises a projecting part formed in the guide groove of the housing to block a movement of the slide projection of the wiping member.

10. The maintenance apparatus according to claim 8, the capping maintaining angle is set within a range of 2°–10°.

11. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the transmission unit includes at least one gear member operatively connected to the capping member mover and the wiping member mover to reduce the rotation force and transmit the reduced rotation force to the capping member mover and the wiping member mover.

12. The maintenance apparatus of claim 11, wherein the capping member mover changes the rotation force of the transmission unit into a capping force and transmits the capping force to the capping member to move the capping member in the capping direction.

13. The maintenance apparatus of claim 11, wherein the wiping member mover changes the rotation force of the transmission unit into a wiping force transmitted to the wiping member to move the wiping member in the wiping direction parallel to the surface of the nozzles.

14. The maintenance apparatus of claim 11, wherein the wiping member mover and the capping member mover control the capping member and the wiping member to perform the capping operation and the wiping operation, respectively, when the transmission unit generates the rotation force in the first direction.

15. The maintenance apparatus of claim 11, wherein the wiping member mover and the capping member mover control the capping member and the wiping member to perform the cap-releasing operation and the wiping operation, respectively, when the transmission unit generates the rotation force in the second direction.

16. The maintenance apparatus of claim 11, wherein the capping member mover and the wiping member mover both comprise a common crank gear coupled to the transmission unit.

17. The maintenance apparatus of claim 11, wherein the housing comprises at least one guide groove, and the wiping member comprises at least one slide projection sliding in and along the guide groove of the housing when the wiping member mover moves the wiping member in the wiping direction.

18. The maintenance apparatus of claim 11, wherein the housing comprises a stopper stopping the movement of the capping member mover and the wiping member mover to maintain the capping member in the capping position.

19. The maintenance apparatus of claim 11, wherein the inkjet printer comprises an additional printing head with a plurality of additional nozzles, and the capping member comprises an additional cap closing and opening a surface of the additional nozzles of the additional printing head.

20. The maintenance apparatus of claim 19, wherein the wiping member comprises an additional wiper wiping the surface of the additional nozzles of the additional printing head.

21. The maintenance apparatus of claim 11, wherein the wiping member comprises:

a horizontal movement body; and a used ink-storing part formed at an upper surface of the horizontal movement body to receive and store ink spat through the nozzles, wherein the wiper is disposed at one side of the upper surface of the horizontal movement body.

22. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the capping member mover comprises a connecting pin rotatable mounted on the housing, and the capping member comprises a first end rotatable coupled to the housing through the connecting pin and a second end coupled to the capping member mover, the capping member rotating about the connecting pin toward the surface of the nozzles in the capping direction, the cap formed on the second end of the capping member opposite to the first end, and wherein the connecting pin of the capping member mover is disposed on the housing to allow the cap of the capping member to move to an intermediate position to contact a portion of the surface of the nozzles with a given-initial angle formed between the cap of the capping member and the surface of the nozzles when the capping member mover moves the capping mover toward the capping positions, and then move from the intermediate position to the capping position to gradually close up the surface of the nozzles in the capping direction, the cap of the capping member being parallel to the surface of the nozzles in the capping position.

23. The maintenance apparatus of claim 22, wherein the given-initial angle is about in the range of 2°–1°.

24. The maintenance apparatus of claim 22, wherein the capping member contacts a portion of the surface of the nozzles in the intermediate position and contacts the remaining portion of the surface of the nozzles in the capping position to prevent an inflow of pressured air into the nozzles in the capping operation.

25. The maintenance apparatus of claim 24, wherein the cap of the capping member forms a sealed space with the surface of the nozzles when the capping member moves from the intermediate position to the capping position.

26. The maintenance apparatus of claim 25, wherein the capping mover moves the capping member from the capping position to a second capping position, and an air pressure inside the sealed space is decreased when the capping member moves from the capping position to the second capping position to avoid an additional air pressure to the nozzles.

27. The maintenance apparatus of claim 26, wherein the capping member maintains the sealed space with the surface of the nozzles in the second capping position, the cap of the capping member being closer to the surface of the nozzles in the capping operation than the second capping position.

28. The maintenance apparatus of claim 26, wherein the capping member mover moves the capping member from the second capping position to the cap standby position through the capping position in the cap-releasing operation.

29. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the capping member rotates in the first direction in response to the rotation force of the maintenance unit in the first direction, and the wiping member moves in the wiping direction parallel to the surface of the nozzle in response to the rotation force of the maintenance unit.

30. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the capping member mover comprises, a connecting pin rotatably coupling the capping member to the housing, a first crank mechanism having a crank gear engaged to the transmission, a crank axle coaxially connected to the crank gear, a first crank arm connected to the crank axle, and a first connecting rod coupled between the first crank arm and the capping member.

31. The maintenance apparatus of claim 30, wherein the wiping member mover comprises:

a second crank mechanism having the crank gear engaged to the transmission;

the crank axle coaxially connected to the crank gear;

a second crank arm coupled to the crank axle; and a second connecting rod coupled between the second crank arm and the wiping member.

32. The maintenance apparatus of claim 30, wherein the wiping member comprises a used ink-storing part, and the connecting pin contacts the wiping member in one of the wiper standby positions to allow the used ink-storing part of the wiping member to be disposed in a spitting position below the nozzles when the capping member and wiping member are in the cap standby position and the one of the wiper standby positions, respectively.

33. The maintenance apparatus of claim 32, wherein a spitting operation is performed to clean the surface of the nozzles when the used ink-storing part of the wiping member is disposed in the spitting position after the cap-releasing and swiping operations.

34. The maintenance apparatus of claim 32, wherein the used ink-storing part comprises an ink absorbing material, and the ink spat from the nozzles is absorbed by and stored in the ink absorbing material.

35. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the capping member mover forms a given capping-maintaining angle with the wiping member mover to maintain the capping member in the capping position when the stopper stops the movement of the capping member mover and the wiping member mover.

36. The maintenance apparatus of claim 35, wherein the stopper controls the capping member to be maintained in the capping position when the transmission does not generate the rotation force.

37. A maintenance apparatus of an inkjet printer having a printing head with a plurality of nozzles moving between a printing area and a maintenance area along a printing direction, comprising:

a housing disposed in the maintenance area;

a capping member disposed in the housing and having a cap closing up a surface of the nozzles of the printing head in a capping position in a capping operation and opening the surface of the nozzles in a cap standby position in a cap-releasing operation;

a wiping member disposed in the housing and having a wiper wiping the surface of the nozzles of the printing head in a wiping operation between wiper standby positions;

a transmission unit disposed on the housing to generate a rotation force in a first direction and a second direction;

a capping member mover moving the capping member to the capping position in the capping operation in a capping direction substantially perpendicular to the printing direction or to the cap standby position in the cap-releasing operation in a cap-releasing direction in response to the rotation force of the transmission unit; and a wiping member mover moving the wiping member in the wiping operation in a wiping direction substantially perpendicular to the printing direction in response to the rotation force of the transmission, wherein the capping member comprises a rotation movement body, a fixing part formed on the rotation movement body, the cap disposed in the fixing part; and an elastic element disposed between the fixing part and the cap to push the cap against the surface of the nozzles.

38. A maintenance apparatus of an inkjet printer having a printing head with a plurality of nozzles and a head driving motor moving the printing head between a printing area and a maintenance area along a printing direction, comprising:

a housing disposed in the maintenance area;

a transmission unit having a maintenance motor generating a rotation force in a first direction and a second direction;

a capping member disposed in the housing and having a cap closing up a surface of the nozzles of the printing head and forming a sealed space between the surface and the cap in a capping position in a capping operation and opening the surface of the nozzle in a cap-releasing operation in response to the rotation force of the transmission unit;

a wiping member disposed in the housing and having a wiper wiping the surface of the nozzles of the printing head in a wiping operation in response to the rotation force of the transmission unit; and a capping member mover moving the capping member to the capping position in a capping direction substantially perpendicular to the printing direction and moving from the capping position to a second capping position in the capping direction, wherein the capping member is closer to the surface of the nozzles in the capping position than the second capping position, and the sealed space is maintained in the second capping position.

39. The maintenance apparatus claim 38, wherein the capping member mover changes the rotation force to the capping force in a direction perpendicular to the surface of the nozzles.

40. The maintenance apparatus claim 38, further comprising:

a wiping member mover moving the wiping member between wiper standby positions in a wiping direction substantially perpendicular to the printing direction and the capping direction in response to the rotation force of the transmission.

41. A method in a printer comprising a printing head having a plurality of nozzles and moving a printing direction, a capping member, and a wiping member, the method comprising:

generating a rotation force to be transmitted to the capping member and the wiping member;

moving the capping member from a cap standby position to an intermediate position having an angle with a surface of the nozzle to contact a portion of a surface of the nozzles;

moving the capping member from the intermediate position to a capping position allowing the capping member to form a sealed space between the cap member and the surface and to close the surface of the nozzles in a capping direction substantially perpendicular to the printing direction in a capping operation in response to the rotation force of the transmission; and moving the wiping member from a first standby position to a second standby position to wipe the surface of the nozzle in a wiping operation in a wiping direction perpendicular to the printing direction.

42. The method of claim 41, further comprising:

moving the capping member from the capping position to a second capping position while maintaining the sealed space, Wherein the capping member is closer to the surface in the capping position than the second capping position.

43. The method of claim 41, wherein the capping direction of the capping member and the wiping direction of the wiping member are perpendicular to each other.

44. A method in a printer having a printing head with a plurality of nozzles moving between a printing area and a maintenance area along a printing direction, a housing, a capping member, and a wiping member, the method comprising:

generating a rotation force from a transmission unit;

rotating the capping member between a first area of the housing and an inside area of the housing with respect to an axis of a shaft supported by the housing in response to the rotation force of the transmission unit to close up and open a surface of the printing head; and moving the wiping member between the first area and a second area of the housing in response to the rotation force of the transmission unit to wipe the surface of the printing head.

45. The method of claim 44, wherein the rotating of the capping member and the moving of the wiping member comprise:

exclusively moving one of the capping member and the wiping member to the first area.

46. The method of claim 44, wherein the rotating of the capping member comprises:

rotating the capping member to the first area when the wiping member moves to the second area.

47. The method of claim 44, wherein the rotating of the capping member comprises:

rotating the capping member to the first area when the printing head is in a stationary state in the maintenance area.

48. The method of claim 44, wherein the moving of the wiping member comprises:

moving the wiping member to the first area when the capping member moves to the inside area.

49. The method of claim 44, wherein the moving of the wiping member comprises:

moving the wiping member to the first area when the printing head is in a stationary state in the maintenance area.

50. The method of claim 44, further comprising:

performing a capping operation using the capping member, a wiping operation using the wiping member, and a spitting operation using a spitting member when the printing head is disposed in the first area.

51. A maintenance apparatus of an inkjet printer having a printing head with a plurality of nozzles moving between a printing area and a maintenance area along a printing direction, comprising:

a housing disposed in the maintenance area and having a first area, a second area, and an inside area;

a transmission unit generating a rotation force;

a capping member having a shaft supported by the housing, rotating between the first area and the inside area with respect to an axis of the shaft in response to the rotation force of the transmission unit to close up and open a surface of the printing head; and a wiping member moving between the first area and the second area in response to the rotation force of the transmission unit to wipe the surface of the printing head.

52. The maintenance apparatus of claim 51, wherein the first area and the second area are formed by the housing and the printing head, and the nozzles of the printing head are disposed in the first area when the printing head moves to the maintenance area.

53. The maintenance apparatus of claim 51, wherein the capping member and the wiping member are disposed in an inside portion of the housing and exposed to the printing head through the first area.

54. The maintenance apparatus of claim 51, wherein the capping member and the wiping member are exclusively disposed on the first area.

55. The maintenance apparatus of claim 51, wherein the capping member is disposed in the first area to close up the surface of the printing head, and the wiping member is disposed in the first area to wipe the surface of the printing head.

56. The maintenance apparatus of claim 51, wherein the capping member moves to the first area to close up the surface of the printing head when the wiping member is disposed in the second area.

57. The maintenance apparatus of claim 51, wherein capping member moves from the first area to the inside area when the wiping member moves from the second area to the first area.

58. The maintenance apparatus of claim 51, wherein the capping member does not move between the first area and the inside area by a moving force of the printing head moving between the printing area and the maintenance area.

59. The maintenance apparatus of claim 51, wherein the capping member receives the rotation force from the transmission unit without an interference with the wiping member.

60. The maintenance apparatus of claim 51, wherein the shaft of the capping member is disposed on a side of the first area opposite to the second area.

61. The maintenance apparatus of claim 51, wherein the shaft of the capping member stops the wiping member at the first area when the wiping member moves from the second area to the first area.

62. The maintenance apparatus of claim 51, wherein the housing comprises:

a cover disposed on a plane corresponding to the first area and the second area, and having on opening disposed in the first area through which one of the capping member and the wiping member contacts the printing head.

63. The maintenance apparatus of claim 51, wherein the housing comprises:

a spitting container receiving ink spat from the nozzles of the printing head through the first area.

64. The maintenance apparatus of claim 51, wherein the cover covers an area corresponding to the second area to cover the wiping member disposed in the second area when the capping member is disposed in the first area.

65. The maintenance apparatus of claim 51, wherein the printing head does not move to the second area when the printing head is disposed in the maintenance area.

66. The maintenance apparatus of claim 51, wherein the capping member and the wiping member move to the first area when the printing head is in a stationary state in the maintenance area.

* * * * *

UNITED STATES PATENT AND TRADEMARK OFFICE

CERTIFICATE OF CORRECTION

PATENT NO. : 6,814,424 B2
APPLICATION NO. : 10/292629
DATED : November 9, 2004
INVENTOR(S) : Jin-ho Park It is certified that error appears in the above-identified patent and that said Letters Patent is hereby corrected as shown below:

Column 10, line 40, after “and” insert paragraph return
Column 11, line 19, change “election” to --ejection--
Column 14, line 30, change “1°” to --10°--
Column 17, line 17, change “part;” to --part,--
Column 17, line 49, after “apparatus” insert --of--
Column 17, line 53, after “apparatus” insert --of--
Column 18, line 19, change “Wherein” to --wherein--.

Signed and Sealed this

Fifteenth Day of January, 2008

JON W. DUDAS
*Director of the United States Patent and Trademark Office*